US007131435B2

(12) United States Patent
Iwatsuki et al.

(10) Patent No.: US 7,131,435 B2
(45) Date of Patent: Nov. 7, 2006

(54) CONTROL APPARATUS FOR AN INTERNAL COMBUSTION ENGINE

(75) Inventors: Hideki Iwatsuki, Kariya (JP); Yukihiro Yamashita, Takahama (JP); Atsushi Sugimura, Kariya (JP)

(73) Assignee: Denso Corporation, Kariya (JP)

( * ) Notice: Subject to any disclaimer, the term of this patent is extended or adjusted under 35 U.S.C. 154(b) by 49 days.

(21) Appl. No.: 10/920,157

(22) Filed: Aug. 18, 2004

(65) Prior Publication Data

US 2005/0045165 A1 Mar. 3, 2005

(30) Foreign Application Priority Data

Aug. 29, 2003 (JP) ..... 2003-307006

(51) Int. Cl.
*F02P 3/05* (2006.01)

(52) U.S. Cl. ..... 123/609; 123/625

(58) Field of Classification Search ..... 123/609, 123/625

See application file for complete search history.

(56) References Cited

U.S. PATENT DOCUMENTS 5,043,900 A * 8/1991 Allen et al. ..... 123/609
5,199,405 A * 4/1993 Mukaihira et al. ..... 123/609
6,526,953 B1 * 3/2003 Inagaki ..... 123/609
6,571,783 B1 6/2003 Denz et al.
2003/0089353 A1 5/2003 Gerhardt et al.

FOREIGN PATENT DOCUMENTS

JP 08-338349 12/1996
JP 11-50900 2/1999

* cited by examiner

*Primary Examiner*—Erick R Solis
(74) *Attorney, Agent, or Firm*—Nixon & Vanderhye P.C.

(57) ABSTRACT

In step 400, microcomputer 12 calculates a temperature change amount ΔT1 of ignition coil FC caused by the heat generating from the ignition coil FC, based on a previous calculated temperature T(n−1) of ignition coil FC and an engine rotational speed. In step 410, the microcomputer 12 calculates a temperature change amount ΔT2 of ignition coil FC caused by the heat received from the engine, based on the previous calculated temperature T(n−1) of ignition coil FC and a cooling water temperature of the engine. In step 420, the microcomputer 12 calculates a temperature change amount ΔT3 of ignition coil FC caused by the heat released to the outside, based on the previous calculated temperature T(n−1) of ignition coil FC and an intake air temperature of the engine. Then, in step 430, the microcomputer 12 calculates a present ignition coil temperature T(n) based on these change amounts ΔT1, ΔT2, and ΔT3.

26 Claims, 10 Drawing Sheets

FIG. 11A
| ROTATIONAL SPEED | 0 | 500 | 1000 | · · · · | 8000 |
|---|---|---|---|---|---|
| TEMPERATURE RISE | Δ1 | Δ2 | Δ3 | · · · · | Δn |
FIG. 11B
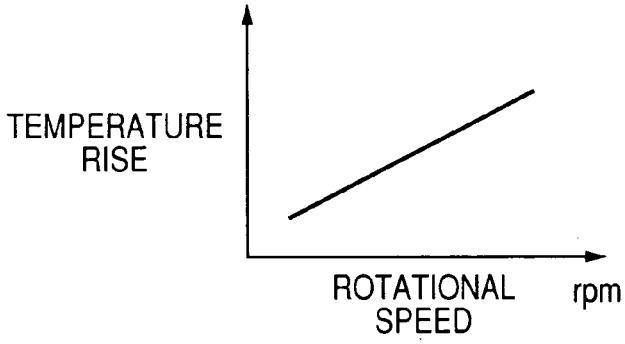
FIG. 12A
| COIL TEMPERATURE | -40 | -20 | 0 | · · · · | 120 |
|---|---|---|---|---|---|
| CORRECTION COEFFICIENT | k1 | k2 | k3 | · · · · | km |
FIG. 12B
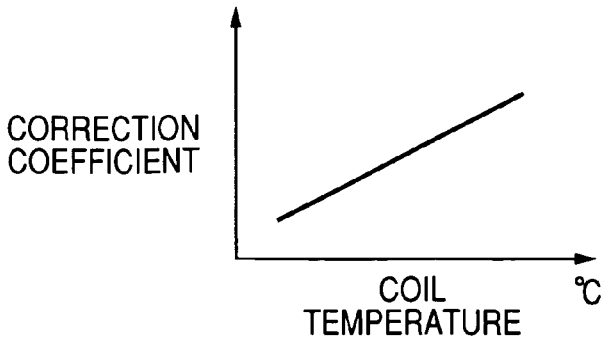

| VEHICLE SPEED | 0 | 20 | 40 | · · · · | 200 |
|---|---|---|---|---|---|
| HEAT RELEASING COEFFICIENT | α1 | α2 | α3 | · · · · | αi |

CONTROL APPARATUS FOR AN INTERNAL COMBUSTION ENGINE

CROSS REFERENCE TO RELATED APPLICATION

This application is based on and incorporates hereinafter by reference Japanese Patent Application No. 2003-307006 filed on Aug. 29, 2003.

BACKGROUND OF THE INVENTION

This application is based upon and claims the benefit of priority of the prior Japanese Patent Application 2003-307006 filed on August, 29.

The present invention relates to a control apparatus for an internal combustion engine that controls electric power supplied to an ignition coil with a power supply amount determined based on a resistance characteristic value of the ignition coil that represents either a resistance value of the ignition coil or a physical quantity having correlation with the resistance value.

The power supply amount supplied to an ignition coil of an internal combustion engine should be an appropriate value within an allowable current range between a maximum current value and a minimum current value. The maximum current value of the ignition coil is generally defined considering protection of an igniter. The minimum current value of the ignition coil is defined considering the possibility of firing failure.

In controlling the electric power supplied to the ignition coil, the current flowing in the ignition coil is dependent on a resistance value of ignition coil. The resistance value of the ignition coil varies depending on the temperature of the ignition coil. Accordingly, even when the power supply control for the ignition coil is performed in the same manner, the current flowing in the ignition coil varies in accordance with the ignition coil temperature. The power supply time for the ignition coil should be changed in accordance with the temperature change in the ignition coil so that the power supply amount to the ignition coil is always within the allowable current range.

The Japanese patent application Laid-open No. 08-338349 discloses a control apparatus which detects the temperature of intake air introduced into an internal combustion engine, an outside air temperature, and the temperature of cooling water flowing in the internal combustion engine. This control apparatus makes a judgment based on these temperature data as to whether the ignition coil temperature is high or low. Then, the control apparatus changes the power supply time required for the ignition coil with reference to the ignition coil temperature, so as to optimize an electric power amount supplied to the ignition coil.

In general, an actual ignition coil generates the heat in response to electric power supplied form a power source, receives the heat from an internal combustion engine, and releases the heat to the outside. Thus, the ignition coil temperature momentarily varies due to these factors. It is therefore difficult to accurately calculate a power supply time reflecting an actual temperature of the ignition coil.

As described above, it may be difficult to accurately calculate a power supply time reflecting the ignition coil temperature. Accordingly, in the case that the power supply amount supplied to the ignition coil exceeds the above-described allowable current range, the current supplied to the ignition coil is regulated with a specific hardware (e.g., regulator). However, the above-described allowable current range is dependent on characteristics of each ignition coil. It will be necessary to develop the regulators so as to be desirable for individual ignition coils.

Furthermore, the surplus of regulated current usually changes into the thermal energy. The temperature of a portion positioned adjacent to the regulator will increase. Especially, a control apparatus incorporating an ignition module will produce a significant amount of heat from the ignition module which serves as a heat generating source. Suppressing such a temperature increase is an important issue to be attained in designing the control apparatus.

Furthermore, in performing the power supply control for the ignition coil, it is generally difficult to appropriately control a power supply amount according to a resistance characteristic value of the ignition coil that represents either a resistance value of the ignition coil or a physical quantity having correlation with the resistance value.

SUMMARY OF THE INVENTION

In view of the above-described problems, the present invention has an object to provide a control apparatus for an internal combustion engine that is capable of appropriately controlling an electric power amount supplied to an ignition coil.

In order to accomplish the above and other related objects, the present invention provides a control apparatus for an internal combustion engine that controls electric power supplied to an ignition coil. A power supply amount is determined based on a resistance characteristic value of the ignition coil that represents either a resistance value of the ignition coil or a physical quantity having correlation with the resistance value. The control apparatus of the present invention sets a predetermined initial value of the resistance characteristic value with reference to initial conditions. The control apparatus calculates a change amount of the resistance characteristic value in the period of time from the previous calculation timing to the present calculation timing with reference to operating conditions of the engine. And, the control apparatus calculates a present resistance characteristic value based on the calculated change amount and the resistance characteristic value obtained at the previous calculation timing.

The resistance value of the ignition coil changes in accordance with the ignition coil temperature. The ignition coil temperature changes due to the heat generating from the ignition coil, the heat received from the outside, and the heat released to the outside. Accordingly, when the power supply amount is determined based on the resistance characteristic value of the ignition coil, it is desirable to appropriately detect the change of the resistance characteristic value of the ignition coil.

In this respect, the control apparatus of the present invention calculates the change amount of the resistance characteristic value in the period of time from the previous calculation timing to the present calculation timing based on operating conditions of the engine. The calculated change amount of the resistance characteristic value is added to a previous resistance characteristic value to obtain the present resistance characteristic value. Therefore, the present invention enables the control apparatus to successively and accurately calculate the resistance characteristic value which momentarily changes in accordance with operating conditions of the engine. Thus, it becomes possible to appropriately control the electric power amount supplied to the ignition coil.

According to the control apparatus of the present invention, it is preferable that the resistance characteristic value is a temperature of the ignition coil.

The temperature change of an ignition coil can be easily calculated based on the heat generation of this ignition coil, the heat received from the outside, and the heat released to the outside. The processing required for the power supply control can be simplified.

The heat generated from an ignition coil is one of main factors that induce any change in the resistance characteristic value of the ignition coil. The ignition coil generates the heat in proportion to a square of the electric power amount supplied to the ignition coil and also in proportion to the resistance value of the ignition coil. The heat quantity generated from the ignition coil is proportional to a multiplication of these values.

The power supply amount required for one firing action of the ignition device should be somewhere within an allowable current range. The electric power amount supplied to the ignition coil is proportional to the number of firing actions. The power supply amount has a correlation with the rotational speed of an internal combustion engine.

In this respect, according to the control apparatus of the present invention, it is preferable that the change amount is a value calculated based on the resistance characteristic value obtained at the previous calculation timing and the rotational speed of the internal combustion engine.

A temperature rise in the ignition coil caused by the heat received from an internal combustion engine is one of main factors that induce any change in the resistance characteristic value of the ignition coil. The heat quantity received from the ignition coil is proportional to a temperature difference between the internal combustion engine and the ignition coil. The resistance value of an ignition coil has correlation with the ignition coil temperature. Therefore, the heat quantity received from the ignition coil is proportional to a different between the temperature of the internal combustion engine and the resistance characteristic value which are expressed by using the same dimension.

In this respect, according to the control apparatus of the present invention, it is preferable that the change amount is a value calculated based on a difference between the resistance characteristic value obtained at the previous calculation timing and the temperature of the internal combustion engine which are expressed by using the same dimension.

When the resistance characteristic value is the ignition coil temperature, it is possible to calculate a change amount of the ignition coil temperature in the period of time from the previous calculation timing to the present calculation timing, based on a difference between the engine temperature and the ignition coil temperature obtained at the previous calculation timing.

The heat received from or released to the outside of the ignition coil is one of main factors that induce any change in the resistance characteristic value of the ignition coil. The heat quantity received from or released to the outside is proportional to a difference between the ambient temperature and the ignition coil temperature. The resistance value of the ignition coil has correlation with the ignition coil temperature. Accordingly, the heat quantity received from or released to the outside is proportional to a difference between the ambient temperature and the resistance characteristic value which are expressed by using the same dimension.

In this respect, according to the control apparatus of the present invention, it is preferable that the change amount is a value calculated based on a difference between the resistance characteristic value obtained at the previous calculation timing and the ambient temperature of the ignition coil which are expressed by using the same dimension.

When the resistance characteristic value is the ignition coil temperature, it is possible to calculate a change amount of the ignition coil temperature in the period of time from the previous calculation timing to the present calculation timing, based on a difference between the ambient temperature and the ignition coil temperature obtained at the previous calculation timing.

The internal combustion engine is usually equipped with a detecting device for detecting the temperature of the cooling water flowing in this internal combustion engine. The cooling water temperature appropriately represents the temperature of the internal combustion engine.

In this respect, according to the control apparatus of the present invention, it is preferable that the temperature of the internal combustion engine is detected as the temperature of the cooling water flowing in the internal combustion.

The internal combustion engine is usually equipped with a detecting device for detecting the temperature of the intake air introduced into an internal combustion engine. The intake air temperature appropriately represents the ambient temperature of the ignition coil.

In this respect, according to the control apparatus of the present invention, it is preferable that the ambient temperature of the ignition coil is detected as the temperature of the intake air introduced into the internal combustion engine.

The heat quantity released from the ignition coil to its surrounding environment changes in accordance with the flow velocity of the air surrounding the ignition coil. On the other hand, an automotive vehicle installing an internal combustion engine is usually equipped with a detecting device for detecting the traveling speed of this automotive vehicle. The vehicle traveling speed appropriately represents the flow velocity of the air surrounding the ignition coil.

In this respect, according to the control apparatus of the present invention, it is preferable that the change amount of the resistance characteristic value is calculated by multiplying a coefficient with the difference. The coefficient relates to the traveling speed of a vehicle that installs the internal combustion. The difference is obtained as a difference between the resistance characteristic value obtained at the previous calculation timing and the ambient temperature of the ignition coil which are expressed by using the same dimension.

When the engine is in a stopped condition, the resistance characteristic value of the ignition coil changes in response to the heat received from the internal combustion engine and the heat released to the outside air. The heat quantity received from the internal combustion engine is dependent on the temperature of the internal combustion engine. Furthermore, the heat quantity released to the outside air is dependent on the outside air temperature.

In this respect, according to the control apparatus of the present invention, it is preferable that the predetermined initial value of the resistance characteristic value is determined based on at least one of the engine temperature and the outside air temperature in a startup condition of the internal combustion engine.

Furthermore, according to the control apparatus of the present invention, it is preferable that the predetermined value is determined with reference to the resistance characteristic value, when the cooling water temperature in the startup condition of the engine is higher than the temperature of the ignition coil corresponding to the resistance characteristic value in the engine stopped condition.

The present cooling water temperature may be higher than the ignition coil temperature in the engine stopped condition when a relatively short time has passed after stopping the engine. In such a condition, the ignition coil and its surrounding environment will not reach a thermal equilibrium condition. Therefore, in the calculation of the resistance characteristic value in an engine startup condition, it is desirable to consider the change of the resistance characteristic value occurring after stopping the engine in response to the temperature change of the ignition coil with reference to a resistance characteristic value at the time the engine is stopped.

The ignition coil temperature changes due to the heat generating from the ignition coil, the heat received from the outside, and the heat released to the outside.

In this respect, the present invention provides another control apparatus for an internal combustion engine that controls electric power supplied to the ignition coil with a power supply amount determined based on the temperature of the ignition coil. This control apparatus calculates the temperature of the ignition coil based on at least one heat quantities selected from the group consisting of a heat quantity generated from the ignition coil, a heat quantity received by the ignition coil, and a heat quantity released from the ignition coil, which are heat quantities calculated in accordance with operating conditions of the engine.

Furthermore, according to the control apparatus of the present invention, it is preferable that the control apparatus calculates a requisite time required for a crank shaft of an internal combustion engine to rotate from the present crank angle to a designated crank angle corresponding to ignition timing. And, the control apparatus calculates the requisite time by predicting a relationship between times required for the crank shaft to rotate consecutive angular regions positioned before and after the present crank angle based on measurement results with respect to times required for the crank shaft to rotate consecutive angular regions positioned before and after a preceding crank angle advanced a predetermined amount from the present crank angle.

According to the above-described arrangement, it is possible to accurately calculate the requisite time considering rotational fluctuations of the crank shaft occurring due to various factors. It is possible to reduce the margin required in the setting of the power supply time. The power supply time can be surely set in the allowable current range. Accordingly, the resistance characteristic value can be accurately calculated. An appropriate power supply amount is obtained.

BRIEF DESCRIPTION OF THE DRAWINGS

The above and other objects, features and advantages of the present invention will become more apparent from the following detailed description which is to be read in conjunction with the accompanying drawings, in which:

FIG. 11A is a table showing the relationship between the rotational speed of the internal combustion engine and the temperature rise amount of the ignition coil in accordance with the preferred embodiment of the present invention;

FIG. 11B is a graph showing the relationship between the rotational speed of the internal combustion engine and the temperature rise amount of the ignition coil in accordance with the preferred embodiment of the present invention;

FIG. 12A is a table showing the relationship between the ignition coil temperature and the correction coefficient for the temperature rise amount of the ignition coil in accordance with the preferred embodiment of the present invention;

FIG. 12B is a graph showing the relationship between the ignition coil temperature and the correction coefficient for the temperature rise amount of the ignition coil in accordance with the preferred embodiment of the present invention;

DESCRIPTION OF THE PREFERRED EMBODIMENTS

Preferred embodiments of the present invention will be explained hereinafter with reference to the attached drawings.

Hereinafter, a control apparatus for an internal combustion engine in accordance with a preferred embodiment of the present invention will be explained with reference to the attached drawings.

Figure 1:
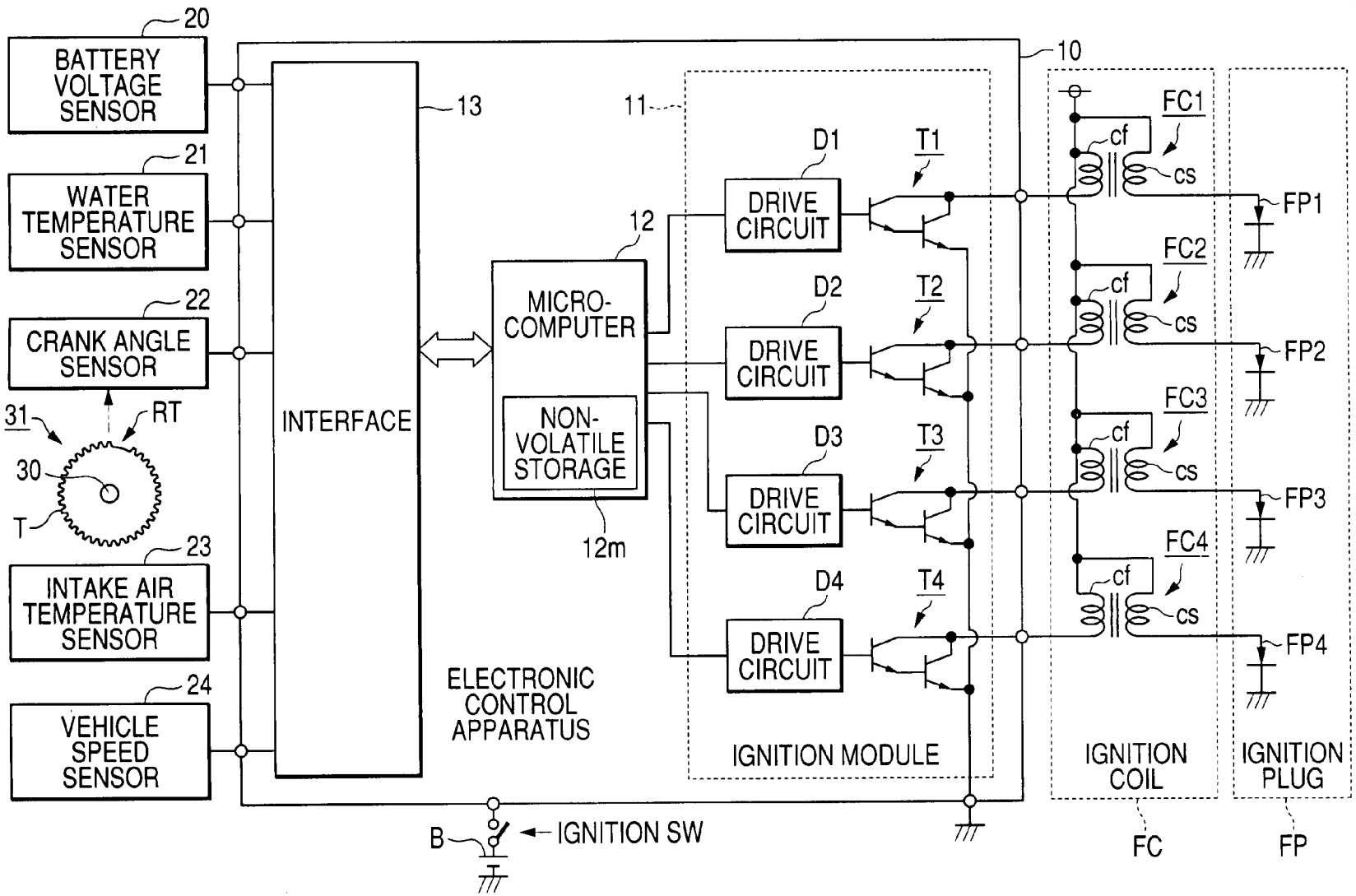
FIG. 1 is a circuit diagram showing the arrangement of an ignition timing control apparatus for an internal combustion engine in accordance with a preferred embodiment of the present invention.

FIG. 1 shows an arrangement of this embodiment that is provided for controlling a 4-cylinder internal combustion engine. The internal combustion engine includes four, i.e. first to fourth, cylinders which are equipped with ignition plugs FP1 to FP4, respectively. Ignition coils FC1 to FC4 generate voltages to control the corresponding ignition plugs FP1 to FP4, respectively. Each of the ignition coils FC1 to FC4 includes a primary coil Cf and a secondary coil Cs. When electric power is supplied to the primary coil Cf, the secondary coil Cs generates a voltage that is applied to a corresponding ignition plug.

Figure 2:
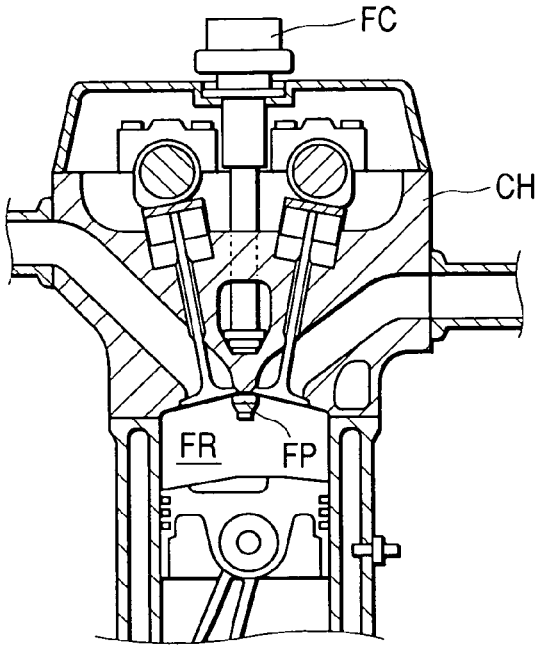
FIG. 2 is a cross-sectional view showing an internal combustion engine in accordance with the preferred embodiment of the present invention.

FIG. 2 shows the ignition plug FP and the ignition coil FC installed in an internal combustion engine. The ignition plug FP, positioned above and facing to a piston, protrudes into a combustion chamber FR of the internal combustion engine. The ignition coil FC is installed on a cylinder head CH of the internal combustion engine. The ignition coil FC is partly brought into contact with the internal combustion engine and is partly exposed to the outside air.

An electronic control apparatus 10 controls electric power supplied to respective ignition coils FC1 to FC4 (more specifically, to respective primary coils Cf). The electronic control apparatus 10 includes an ignition module 11, a microcomputer 12, and an interface 13. The ignition module 11 is a hardware arranged for controlling respective ignition coils FC 1 to FC4. The microcomputer 12 executes various calculation processing required for the ignition control. The interface 13 intervenes for signal transmission between the microcomputer 12 and external devices.

The electronic control apparatus 10 operates under a condition that electric power is supplied from battery B. An ignition switch controls electric power supply from the battery B. The microcomputer 12 includes a nonvolatile storage 12*m* capable of storing control data when no electric power is supplied to the electronic control apparatus 10.

The ignition module 11 includes transistors T1 to T4 and drive circuits D1 to D4 corresponding to respective ignition coils FC1 to FC4. Respective drive circuits D1 to D4 control associated transistors T1 to T4 in response to command signals supplied from the microcomputer 12. Respective ignition coils FC1 to FC4 (more specifically, their primary coils Cf) receive current from an electric power source in response to turning on and off operation of corresponding transistors T1 to T4. The current value supplied to respective ignition coils FC1 to FC4 (more specifically, their primary coils Cf) immediately before stopping power supply determines a voltage value produced from respective ignition coils FC1 to FC4 (more specifically, their secondary coils Cs). Therefore, the microcomputer 12 adjusts an operation amount of the ignition module 11 to control the voltage value applied to respective ignition plugs FP1 to FP4.

To execute the above and other controls, the electronic control apparatus 10 inputs detection signals supplied from various sensors detecting driving operations of an internal combustion engine. The sensors include a battery voltage sensor 20 detecting a battery voltage, a water temperature sensor 21 detecting the temperature of cooling water of the engine, a crank angle sensor 22 detecting rotational conditions of a crank shaft 30 of the engine, an intake air temperature sensor 23 detecting the temperature of intake air introduced into the engine, and a vehicle speed sensor 24 detecting the traveling speed of an automotive vehicle installing this engine.

The crank angle sensor 22 is an electromagnetic type sensor that outputs a crank signal produced based on electromagnetic induction occurring between detection teeth of a rotating timing rotor 31 and a core of the crank angle sensor 22. As shown in FIG. 1, the detection teeth T are arranged at equal intervals, e.g. 10 degrees, along the circumferential periphery of the timing rotor 31. This interval corresponds to an equiangular rotation of the crank shaft. There is a toothless portion RT having a width equivalent to two teeth. The toothless portion RT of the timing rotor 31 is used for discriminating each cylinder.

The electronic control apparatus 10 executed the ignition timing control in the following manner. The ignition timing control includes two fundamental steps; i.e. step S1 for calculating a requisite time required for the crank shaft 30 to rotate from a present crank angle detected by the crank angle sensor 22 to ignition timing (defined as a crank angle) determined by the control of an internal combustion engine, and step S2 for calculating a power supply start timing which represents a start timing from which electric power is supplied to the ignition coil FC. The power supply start timing is obtained by subtracting a power supply time from the above requisite time. The power supply time represents a time during which electric power is supplied to the ignition coil FC. The power supply time is determined based on driving conditions of the internal combustion engine. The crank angle is converted into a comparable time with reference to measurement result of a time required for the crank shaft to rotate a predetermined crank angle, in the following manner.

Figure 3:
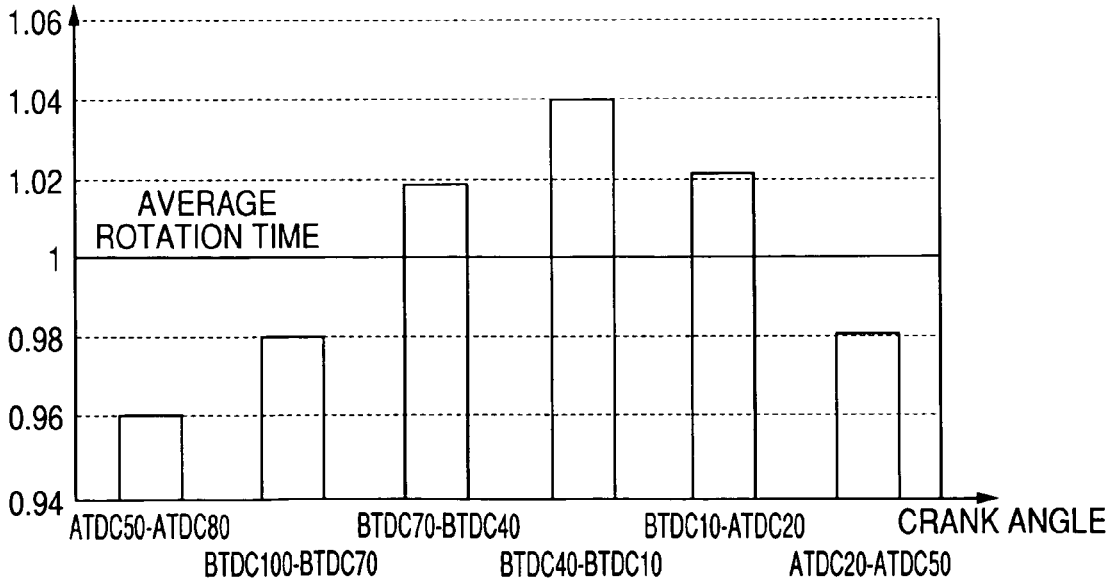
FIG. 3 is a graph showing rotational changes of a crank shaft of a 4-cylinder internal combustion engine.

FIG. 3 shows a time required for the crank shaft 30 to rotate each 30 CA (i.e. crank angle) in the units of crank angle. As understood from FIG. 3, the required time (i.e. a rotational speed of the crank shaft 30) varies in respective crank angle sections. More specifically, as shown in FIG. 3, the crank shaft 30 rotates at higher rotational speeds in a crank angle section "ATDC20-BTDC70" and at lower rotational speeds in a crank angle section "BTDC70-ATDC20." According to the combustion cycle of an internal combustion engine, the ignition plug FP ignites atomized fuel in the combustion chamber. The rotational speed of crank shaft 30 accelerates during the combustion stroke. The rotational speed of crank shaft 30 decelerates in the compression stroke succeeding the combustion stroke.

The rotational changes of crank shaft 30 result from such characteristics of the combustion cycle as well as from acceleration and deceleration of an engine, manufacturing errors of detection teeth T, and combustion efficiency differences of respective cylinders.

Such rotational changes occurring in the crank shaft 30 should be considered in calculating the requisite time. This embodiment measures times required for the crank shaft 30 to rotate consecutive angular regions positioned before and after a preceding crank angle advanced a predetermined amount from the present crank angle. Then, based on the measurement results, this embodiment predicts a relationship between times required for the crank shaft 30 to rotate consecutive angular regions positioned before and after the present crank angle. Based on this prediction, this measurement can accurately calculate a requisite time required for the crank shaft 30 to rotate from the present crank angle to the ignition timing (i.e. designated crank angle).

Figure 4:
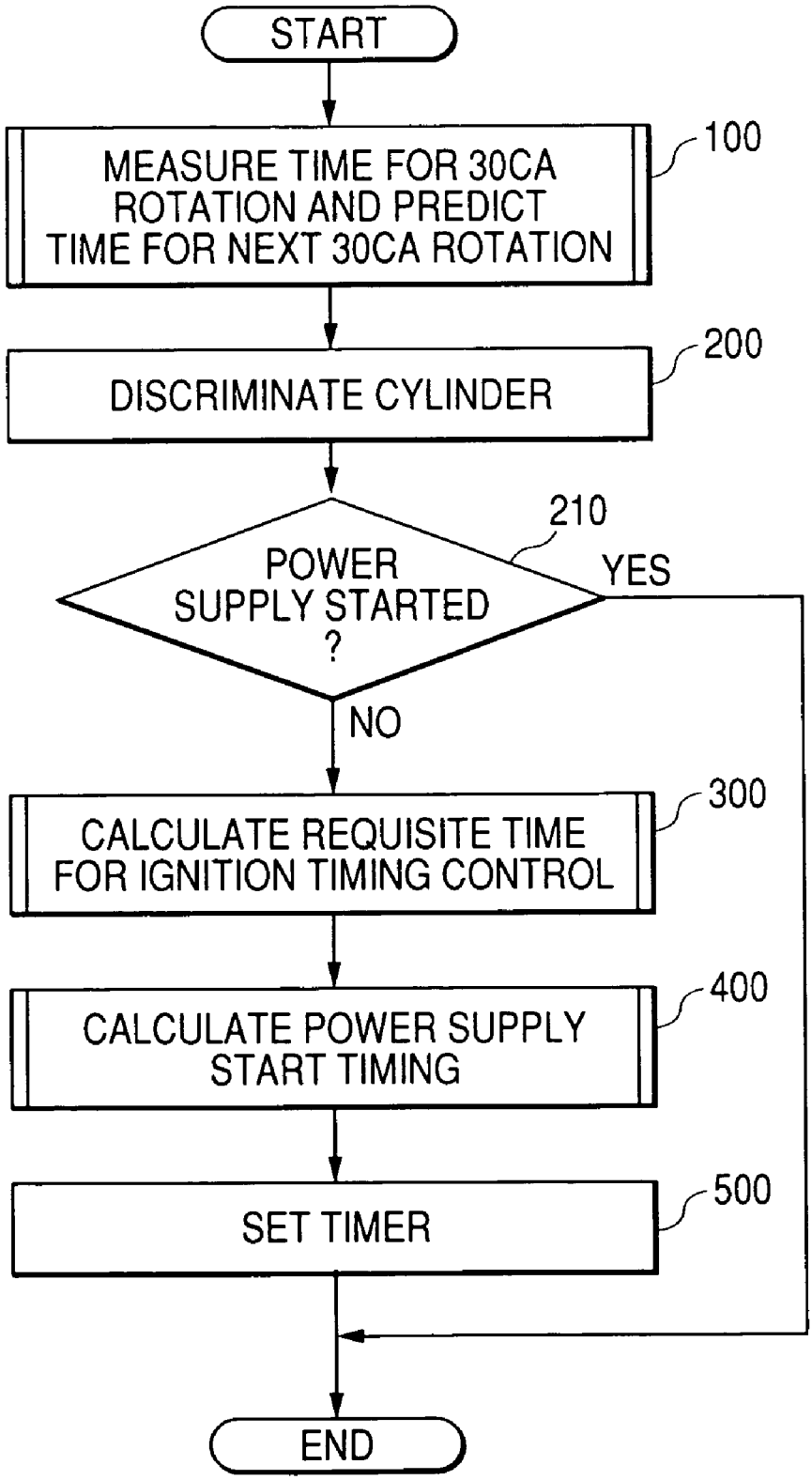
FIG. 4 is a flowchart showing the processing procedure of an ignition timing control in accordance with the preferred embodiment of the present invention.

FIGS. 4 to 8 are flowcharts explaining the ignition timing control procedure according to this embodiment. FIG. 4 is a flowchart showing an overall processing procedure for the ignition timing control periodically performed by the microcomputer 12 at intervals of 30 CA (i.e. crank angle).

Figure 5:
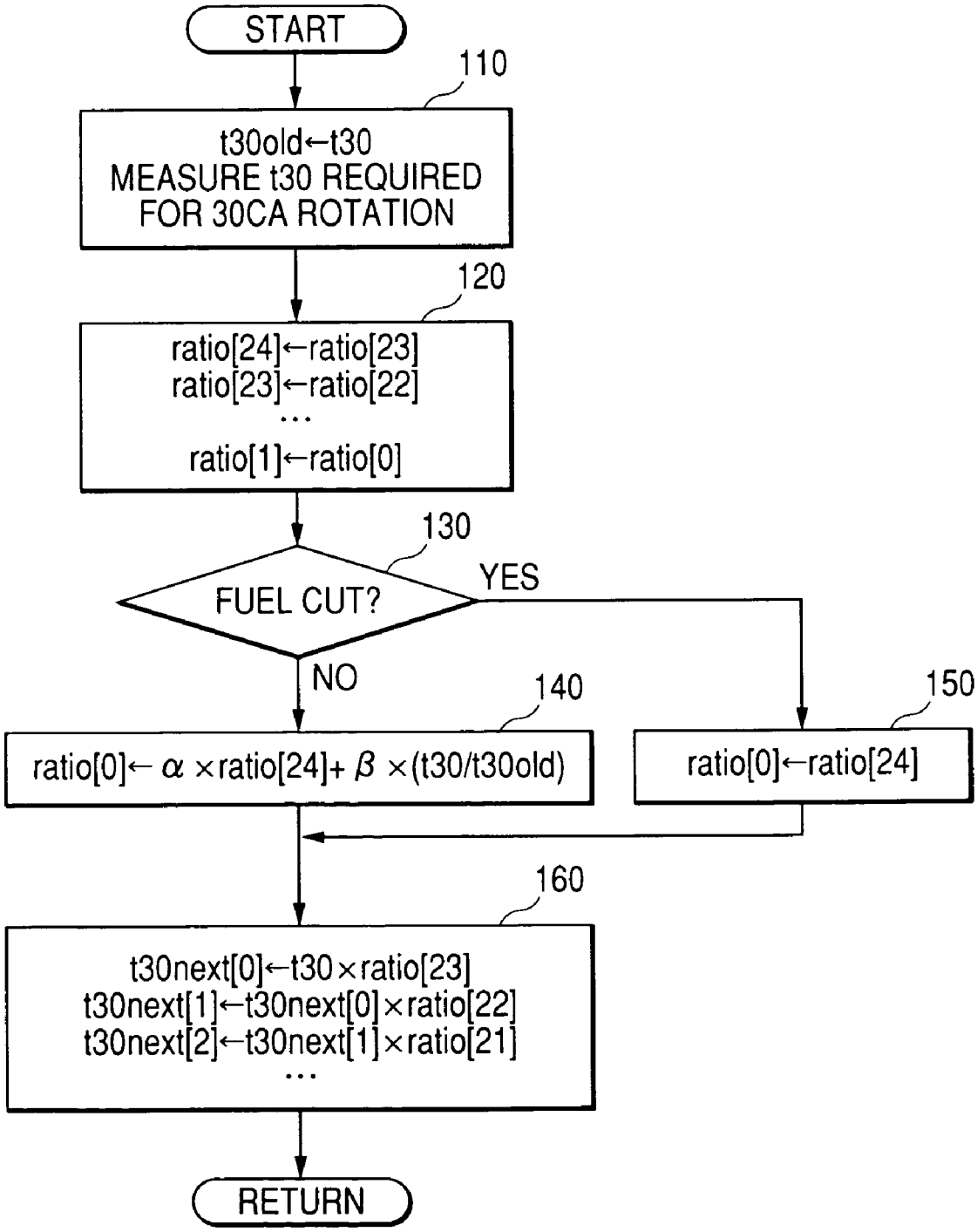
FIG. 5 is a flowchart showing the processing procedure for predicting a time required for a rotation of the crank shaft in accordance with the preferred embodiment of the present invention.

First, in step 100, the microcomputer 12 measures a time required for the latest 30 CA (i.e. crank angle) rotation of crank shaft 30 and predicts a time required for an equiangular rotation of the crank shaft 30 starting from the present crank angle based on the measurement results. The microcomputer 12 repeats the above measurement and prediction in response to every equiangular rotation of the crank shaft 30. FIG. 5 is a flowchart showing details of the step 100.

In FIG. 5, first in step 110, the microcomputer 12 regards a previous 't30' as 't30old' where the previous 't30' represents a measured time required for a 30 CA rotation of crank shaft 30 in the previous cycle. The microcomputer 12 measures a new 't30' as a time required for new 30 CA rotation of crank shaft 30.

Next, in step 120, the microcomputer 12 obtains a ratio of times required for consecutive equiangular rotations of the crank shaft 30 that are time sequentially measured. In each cycle, the microcomputer 12 renews 'ratio[i]' as 'ratio[i+1]', where 'ratio[i]' represents a ratio of time measured 'i' cycles before to time measured 'i+1' cycles before. This embodiment holds a total of 25 ratio data, including 'ratio[0]' representing a ratio of time measured in this cycle to time measured one cycle before, - - - and 'ratio[24]' representing a ratio of time measured 720 CA before to time measured 750 CA before.

Furthermore, in step 130, the microcomputer 12 checks whether a fuel cut control is performed for an internal combustion engine. When no fuel cut control is performed (i.e. NO in step 130), the microcomputer 12 newly calculates the value of 'ratio[0]' representing a ratio of time measured in this cycle to time measured one cycle before (refer to step 140). In this case, the microcomputer 12 removes adverse effects of noises from the measured value 'ratio[0]'. To this end, the microcomputer 12 executes the processing for obtaining a weighted average of the measured times. More specifically, the microcomputer 12 multiplies a predetermined weighting factor β with the ratio 't30/t30old' representing a ratio of time measured in this cycle to time measured one cycle before. Meanwhile, the microcomputer 12 multiplies a predetermined weighting factor α with the 'ratio[24]' representing a ratio of time measured 720 CA before to time measured 750 CA before. Then, the microcomputer 12 adds these weighted values to obtain a ratio 'ratio[0]'.

The reason why this embodiment uses the data measured 720 CA before is that the rotational speed of crank shaft 30 involves fluctuations resulting from manufacturing errors of the detection teeth T and combustion efficiency differences of respective cylinders. It is desirable that the weighting factor α is larger than the weighting factor β.

On the other hand, when the fuel cut control is now performed (i.e.

YES in step 130), the microcomputer 12 executes the processing of step 150.

In step 150, the microcomputer 12 regards the value of 'ratio[0]' as being identical with 'ratio[24]' without newly calculating the value of 'ratio[0]' representing a ratio of time measured in this cycle to time measured one cycle before. In other words, during the fuel cut control of the engine, the microcomputer 12 continuously fixes the value of 'ratio[0]' to the value of 'ratio[24]' which represents a ratio of time measured 720 CA before to time measured 750 CA before.

The above control is effective to assure the accuracy in calculating the ignition timing immediately after the fuel injection operation resumes. When no fuel is supplied to an engine, the engine causes no rotational changes resulting from unstable combustion conditions. The measurement results obtained from the crank angle sensor 22 during the fuel cut control are different in characteristics from those obtained when no fuel cut control is executed. If the above-described 'ratio[i]' is calculated during the fuel cut control, it will be difficult to accurately calculate the requisite time when the fuel injection operation resumes. On the contrary, according to the above-described processing, the microcomputer 12 retains the value of 'ratio[i]' measured before the fuel cut control is executed. Thus, the microcomputer 12 can accurately calculate the requisite time when the fuel injection operation resumes considering the rotational changes resulting from unstable combustion conditions.

After finishing the processing of step 140 or step 150, the microcomputer 12 executed the processing of step 160. In step 160, the microcomputer 12 calculates 't30next[i]' representing predicted time required for a 30 CA rotation of crank shaft 30 starting from a crank angle '30×i', wherein '30×i' is defined with respect to the present crank angle serving as a zero point. For example, 't30' represents time measured at the present crank angle, and 'ratio[23]' represents a ratio of time measured 720 CA before to time measured 690 CA before. The predicted time required for a 30 CA rotation of crank shaft 30 starting from the present crank angle is obtained as a multiplication of these values, i.e. 't30next[0]'='t30'×'ratio[23]'. In general, 't30next[i]' representing predicted time required for a 30 CA rotation of crank shaft 30 starting from a crank angle '30×i' can be expressed by the following equation.

$$\text{'}t30\text{next}[i]\text{'} = \text{'}t30\text{next}[i-1]\text{'} \times \text{'ratio}[23-i]\text{'}$$

In the processing of step 160, the microcomputer 12 calculates 't30next[i]' primarily based on 'ratio[23]' representing a ratio of time measured 720 CA before to time measured 690 CA before. Using the value 'ratio[23]' as a basic reference value is effective in eliminating adverse effects of unstable rotation of crank shaft 30 which usually result from manufacturing errors of the above-described detection teeth T and combustion efficiency difference of respective cylinders.

After finishing the processing of step 160, the microcomputer 12 executes the processing of step 200 shown in FIG. 4. In step 200, the microcomputer 12 discriminates a cylinder as an object of the ignition timing control. More specifically, the microcomputer 12 judges whether the present crank angle is positioned in the compression stroke or the combustion and expansion stroke in respective, i.e. first to fourth, cylinders. To this end, a crank angle region 'BTDC 270-ATDC90' including the ignition timing is assigned to each cylinder. The microcomputer 12 identifies a cylinder in which the present crank angle is present in the above-described crank angle region.

After any cylinder is identified in step 200, the microcomputer 12 executes the succeeding processing of steps 210 to 500 for the identified cylinder. The crank angles used in these steps should be defined for respective cylinders.

Figure 6:
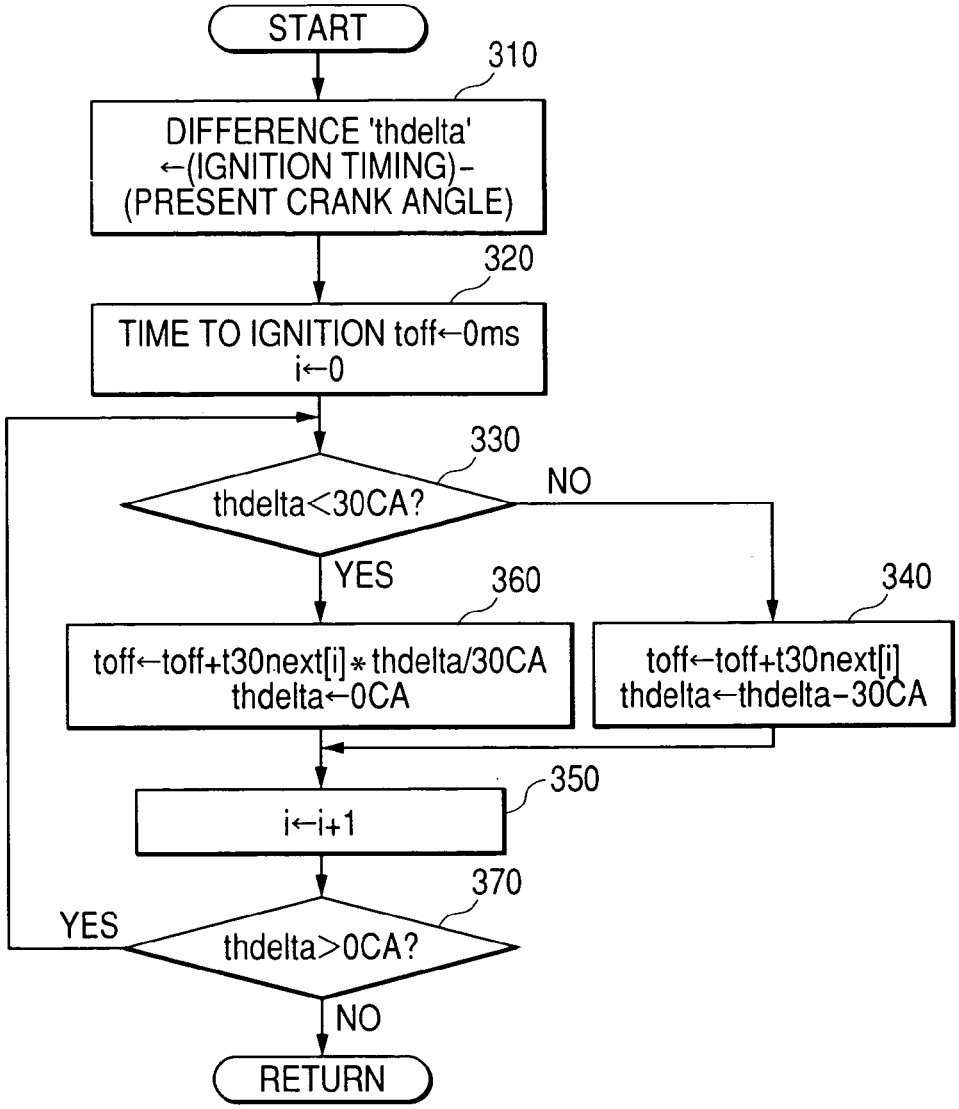
FIG. 6 is a flowchart showing the processing procedure for calculating a requisite time required for the ignition timing control in accordance with the preferred embodiment of the present invention.

After finishing the processing of step 200, the microcomputer 12 checks in step 210 if power supply is already started in the corresponding cylinder. Then, when the power supply is already started (i.e. YES in step 210), the microcomputer 12 terminates this routine. On the other hand, when the power supply is not started yet (i.e. NO in step 210), the microcomputer 12 executes the processing of step 300. In step 300, the microcomputer 12 calculates a requisite time required for the crank shaft 30 to rotate from the present crank angle to a crank angle indicating the ignition timing. FIG. 6 shows details of the processing performed in step 300.

In the routine show in FIG. 6, first in step 310, the microcomputer 12 calculates a difference 'thdelta' representing a difference between the present crank angle and the crank angle indicating the ignition timing. The ignition timing should be set to an appropriate time considering driving conditions of an engine.

Next, in step 320, the microcomputer 12 initializes a variable 'toff' which is used to calculate the time required for the crank shaft 30 to rotate from the present crank angle to the crank angle indicating the ignition timing. Furthermore, the microcomputer 12 initializes another variable 'i' in this step.

Next, the microcomputer 12 executes sequential calculations in the processing of succeeding steps 330 to 370 to predict the time required for the crank shaft 30 to rotate from the present crank angle to the crank angle indicating the ignition timing. More specifically, the microcomputer 12 calculates a time required for each 30 CA rotation of crank shaft 30 based on the time obtained in the processing of step 160 shown in FIG. 5, in response to each 30 CA increment from the present crank angle.

More specifically, in step 330, the microcomputer 12 checks whether the difference 'thdelta' is less than 30 CA. The difference 'thdelta' is a difference between the present crank angle and the crank angle indicating the ignition timing. When the difference 'thdelta' is less than 30 CA (i.e. YES in step 330), the microcomputer 12 cannot calculate time required for a 30CA rotation of crank shaft 30 by directly using the time obtained in the processing of step 160 shown in FIG. 5. Thus, the microcomputer 12 performs the processing of step 360.

On the other hand, when the difference 'thdelta' is equal to or larger than 30 CA (i.e. NO in step 330), the microcomputer 12 executes the processing of step 340. In step 340, the microcomputer 12 calculates a time required for a 30 CA rotation of crank shaft 30 from a predetermined crank angle based on the time obtained in the processing of step 160 shown in FIG. 5. More specifically, when the control procedure first proceeds to step 340 after finishing initialization of the above-described variable 'i', the microcomputer 12 renews the above-described variable 'toff' by adding 't30next[0]' to this variable 'toff', wherein 't30next[0]' represents a time required for a 30 CA rotation of crank shaft 30 from the present crank angle. When the microcomputer 12 executes the processing of step 340 next time, the microcomputer 12 renews the variable 'toff' by adding 't30next[1]' to this variable 'toff', wherein 't30next[1]' represents a time required for a 30 CA rotation of crank shaft 30 from a crank angle retarded from the present crank angle by 30 CA. In this manner, the microcomputer 12 subtracts 30 CA from the value of difference 'thdelta' each time the above-described variable 'toff' is renewed. The microcomputer 12 executes the processing of succeeding steps 350 and 370 and then returns to step 330. The microcomputer 12 repeats the processing of step 340 until the remaining difference 'thdelta' becomes smaller than 30 CA through such circulative calculations.

Meanwhile, when the remaining difference 'thdelta' is less than 30 CA (i.e. YES in step 330), the microcomputer 12 executes the processing of step 360. In step 360, the microcomputer 12 calculates the value of variable 'toff' for the remaining crank angle region having been not processed in the above steps S340. More specifically, the microcomputer 12 obtains a time corresponding to the remaining crank angle region based on the time 't30 next[i]' calculated in step 160 of FIG. 5, by introducing a linear interpolation based on a time required for a 30 CA rotation of crank shaft 30 including this remaining crank angle region. The microcomputer 12 renews the variable 'toff' by adding this 'toff' to the interpolated data (i.e. t30next[i]×thdelta/30 CA). In calculating the requisite time required for the crank shaft 30 to rotate from the present crank angle to the crank angle indicating the ignition timing in step 340 or in step 360, the microcomputer 12 uses the predicted time 't30next[i]' shown in FIG. 5. The predicted time 't30next[i]' includes the data corresponding to the crank angle indicating the ignition timing.

Meanwhile, the microcomputer 12 regards the value of 'thdelta' as 0 CA in the step 360. After finishing the processing of step 360, the microcomputer 12 executes the processing of step S350 in which the variable 'i' is incremented by 1. Then, the microcomputer 12 executes the processing of step 370 in which the microcomputer 12 checks whether or not the remaining difference 'thdelta' is larger than 0 CA. When the remaining difference 'thdelta' is larger than 0 CA (i.e. YES in step 370), the microcomputer 12 returns to the processing of step 330. When the remaining difference 'thdelta' is not larger than 0 CA (i.e. NO in step 370), the microcomputer 12 terminates this routine and proceeds to the processing of step 400 in FIG. 4.

Figure 7:
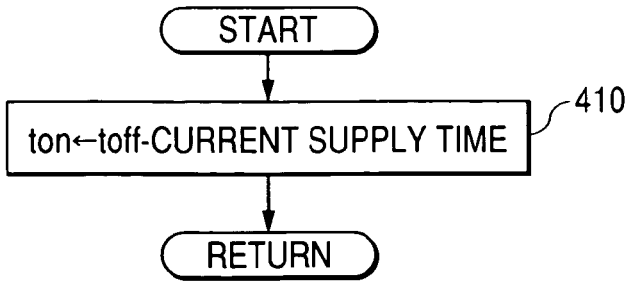
FIG. 7 is a flowchart showing the processing procedure for calculating the power supply start timing in accordance with the preferred embodiment of the present invention.

In step 400, the microcomputer 12 calculates power supply start timing 'ton' based on the ignition timing calculated in the step 300. FIG. 7 shows the processing of step 400. As shown in FIG. 7, in step 410, the microcomputer 12 calculates the power supply start timing 'ton' by subtracting a power supply time from the above-described variable 'toff', wherein 'toff' represents a time required for the crank shaft 30 to rotate from the present crank angle to the crank angle indicating the ignition timing as explained with reference to the flowchart of FIG. 6.

After finishing the processing of step 400, the microcomputer 12 executes the processing of step 500 shown in FIG. 4. In step 500, the microcomputer 12 sets timers for the power supply start timing 'ton' calculated in the step 400, and the ignition timing calculated in the step 300.

Figure 8:
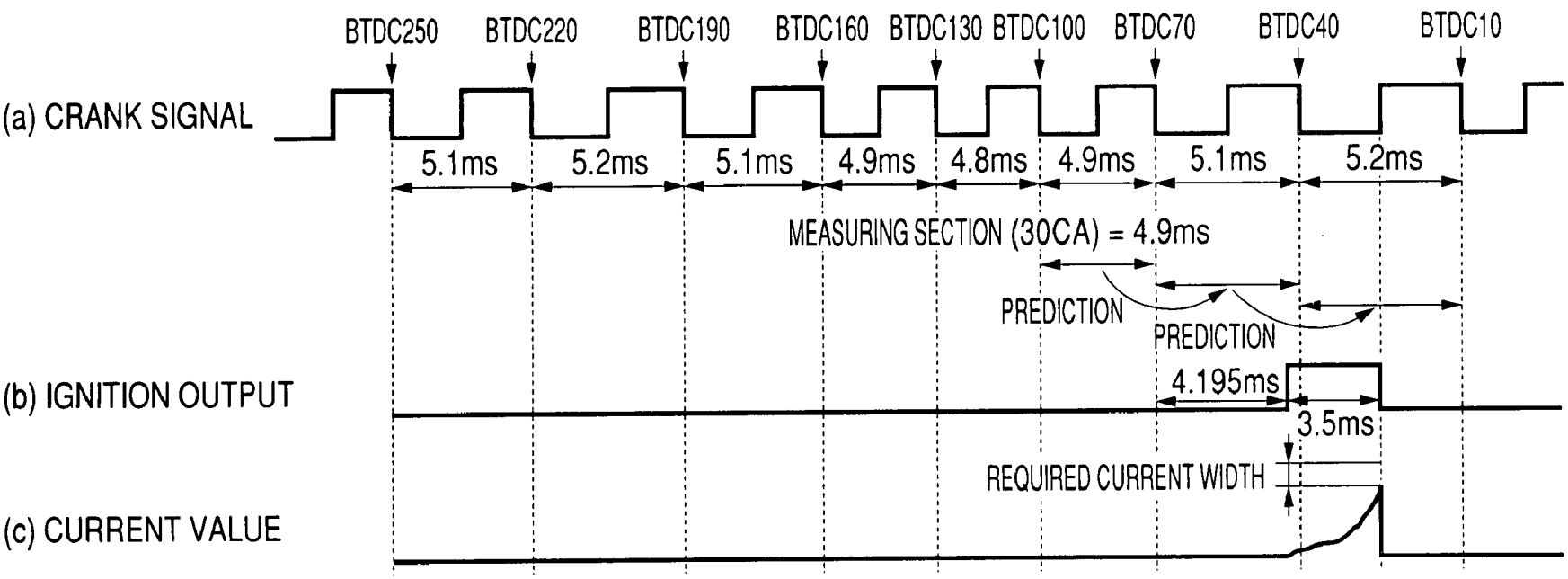
FIG. 8 is a timing chart showing the ignition timing control in accordance with the preferred embodiment of the present invention.

FIG. 8 is a timing chart showing the ignition timing control performed by the microcomputer 12 in accordance with this embodiment of the present invention. In FIG. 8, (a) represents a crank signal, (b) represents calculation result of an ignition output, and (c) represents a current value supplied to the ignition coil. In FIG. 8, it is assumed that the crank shaft 30 periodically causes rotational changes. The power supply time is 3.5 ms, and the ignition timing is set to 'BTDC 25'.

When the present crank angle is 'BTDC70', the microcomputer 12 sets the ignition timing and the power supply start timing as explained with reference to FIG. 4. In this case, 't30' is 4.9 msec. As explained in FIG. 5, 't30' represents a time required for a rotation of crank shaft 30 from BTDC100 to BTDC70 that corresponds to a 30 CA rotation measured in the present cycle. Furthermore, the values of 'ratio[23]' and 'ratio[22]' are different from each other due to rotational changes occurring periodically, and are obtained as 1.04 (=5.1÷4.9) and 1.02 (=5.2÷5.1) respectively.

Accordingly, the ignition timing can be obtained in the following manner.

$$4.9\times1.04+(15/30)\times4.9\times1.04\times1.02\approx7.695\text{ ms}$$

Furthermore, the power supply start timing can be obtained in the following manner.

$$7.695-3.5=4.195\text{ ms}$$

The predicted time required for a rotation of crank shaft 30, which is used for calculating the power supply start timing and the ignition timing, is substantially equal to actual time. Therefore, no margin is required for the power supply time. The microcomputer 12 can set an appropriate power supply amount so that the output voltage of the ignition coil FC can be optimized for the ignition control of a corresponding ignition plug FP. Therefore, without relying on a regulator, the microcomputer 12 can adjust the current flowing in the ignition coil FC so as to have a width within a required current pulse width. It becomes possible to suppress heat generating in the electronic control apparatus 10.

Especially, according to this embodiment, the microcomputer 12 does not perform these calculations again at the crank angle 'BTDC40' after the power supply operation once starts when the microcomputer 12 executes the processing of step 210 in FIG. 4. Accordingly, the power supply time being set at an appropriate value is not renewed. The microcomputer 12 can accurately control the current flowing in ignition coil FC to a desired value based on the power supply time having been set beforehand so as to provide an appropriate power supply amount.

Furthermore, the microcomputer 12 can accurately calculate the ignition timing by predicting a time required for a 30 CA rotation of crank shaft 30 as described above while the microcomputer 12 gives priority to the power supply time so that this calculation can be accurately performed.

Figure 9:
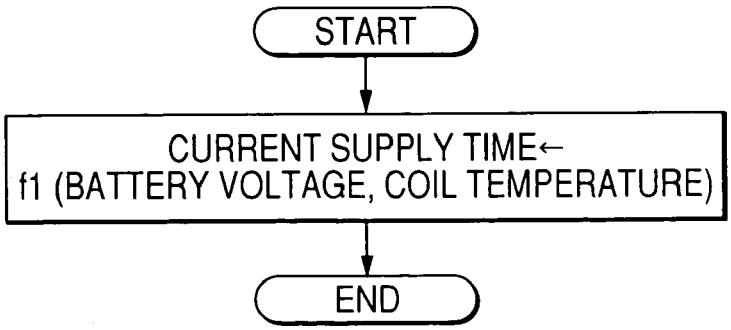
FIG. 9 is a flowchart showing the processing procedure for calculating a power supply time required for the ignition coil in accordance with the preferred embodiment of the present invention.

FIG. 9 is the processing that the microcomputer 12 executes for calculating the power supply time used in the processing of FIG. 7. The processing shown in FIG. 9 is repeated at predetermined intervals (e.g. 25 ms) in the microcomputer 12. The microcomputer 12 obtains a power supply time with reference to a map based on a detection value of the battery voltage sensor 20 and a detection value of the ignition coil temperature. The power supply time being set in this case corresponds to a power supply amount. The voltage produced from the ignition coil FC is a preferable value for the control of the ignition plug FP.

To set the power supply time for the ignition coil FC to an appropriate value, the microcomputer 12 performs the following processing for calculating the temperature of ignition coil FC.

According to this embodiment, the microcomputer 12 calculates a change amount in the temperature of ignition coil FC in the period of time from the previous calculation timing to the present calculation timing with reference to operating conditions of the engine. The microcomputer 12 calculates the present temperature of ignition coil FC based on the calculated change amount and the previous temperature of ignition coil FC. More specifically, the microcomputer 12 calculates the temperature change amount of ignition coil FC considering the fact that the temperature of ignition coil FC changes in response to the heat generating from the ignition coil, the heat received from the outside, and the heat released to the outside.

Figure 10:
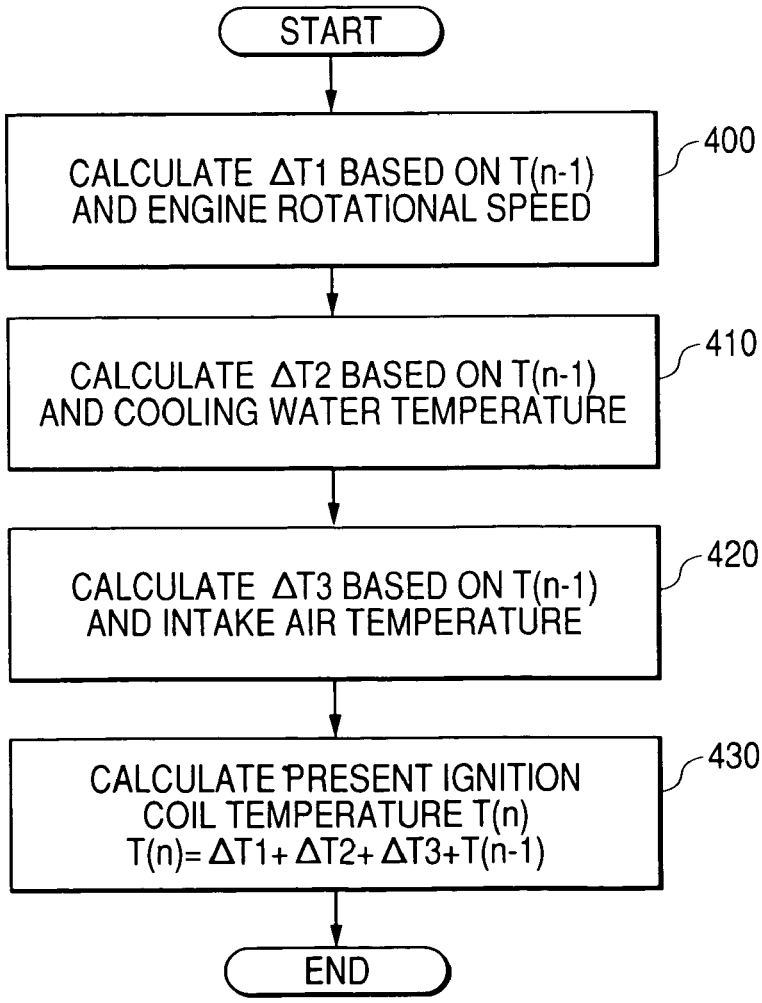
FIG. 10 is a flowchart showing the processing procedure for calculating the temperature of an ignition coil in accordance with the preferred embodiment of the present invention.

FIG. 10 shows the processing procedure for calculating the temperature of ignition coil FC which is executed by the microcomputer 12 in accordance with this embodiment. The microcomputer 12 executes this processing at predetermined intervals.

First in step 400, the microcomputer 12 calculates a temperature change amount $\Delta T1$ of ignition coil FC caused by the heat generating from the ignition coil FC, based on a previous calculated temperature T(n−1) of ignition coil FC and a rotational speed of the internal combustion engine. This temperature change amount is a change amount of the temperature in the period of time from the previous processing cycle to the present processing cycle in the flowchart shown in FIG. 10. The heat quantity generated from ignition coil FC is expressed by using a power supply amount to the ignition coil FC and a resistance value of ignition coil FC. The microcomputer 12 calculates the temperature change amount $\Delta T1$ considering this relationship.

More specifically, the microcomputer 12 uses a map shown in FIG. 11A which defines a relationship between the rotational speed of the internal combustion engine and a temperature rise of ignition coil FC. The microcomputer 12 calculates a fundamental temperature rise with reference this map. The power supply amount to the ignition coil FC during one complete processing cycle is expressed by a product of a power supply amount to the ignition coil FC for one ignition (i.e. one firing action) and the total number of ignitions during one complete processing cycle.

The power supply amount to ignition coil FC in each ignition timing control can be suppressed within an allowable current region. The power supply amount to ignition coil FC in each ignition timing control is substantially constant. The total number of ignitions is related to the rotational speed of the internal combustion engine.

Accordingly, when the resistance value of ignition coil FC is constant, the microcomputer 12 can calculate the temperature rise amount of ignition coil FC based on the rotational speed of the internal combustion engine. FIG. 11A shows a fundamental temperature rise amount of ignition coil FC relative to the rotational speed of the internal combustion engine under a condition that the resistance value of ignition coil FC is a predetermined value. The map shown in FIG. 11A can be prepared based on experimental data.

The microcomputer 12 can obtain a rotational speed value calculated at or in the vicinity of the calculation timing of calculation value T(n−1), which is calculated based on the detection value obtained from the crank angle sensor 22. In this case, the sampling timing closer to the present processing cycle can be set to the previous calculation timing closest to the present processing cycle. When the calculated rotational speed of the internal combustion engine disagrees with the map data shown in FIG. 11A, the microcomputer 12 can obtain an appropriate fundamental temperature rise amount by introducing the interpolation as shown in FIG. 11B.

On the other hand the microcomputer 12 can use a map shown in FIG. 12A which defines a relationship between the temperature of ignition coil FC and a correction coefficient for correcting the calculation result obtained based on the map shown in FIG. 11A. The correction coefficient is a factor showing how the temperature rise amount determined according to the relationship shown in FIG. 11A changes in response to a deviation of the resistance value of ignition coil FC from the above predetermined value. The resistance value of ignition coil FC changes in accordance with the temperature of ignition coil FC. Considering this fact, this embodiment determines the relationship between the temperature of ignition coil FC and the correction coefficient. This map can be prepared based on experimental data.

The microcomputer 12 calculates a proper correction coefficient with reference to this map based on the previous calculation value T(n−1). When the previous calculation value T(n−1) disagrees with the map data shown in FIG. 12A, the microcomputer 12 can obtain an appropriate correction coefficient by introducing the interpolation as shown in FIG. 12B.

Then, the microcomputer 12 multiplies the fundamental temperature rise amount with the correction coefficient to obtain the temperature change amount $\Delta T1$ of ignition coil FC caused by the heat generated from the ignition coil FC.

Next, in step 410 shown in FIG. 10, the microcomputer 12 calculates a temperature change amount $\Delta T2$ of ignition coil FC caused by the heat received from the internal combustion engine, based on the previous calculated temperature T(n−1)

of ignition coil FC and a cooling water temperature of the internal combustion engine. This temperature change amount is a change amount of the temperature in the period of time from the previous processing cycle to the present processing cycle in the flowchart shown in FIG. 10. The heat quantity received from the internal combustion engine is proportional to a difference between the temperature of the internal combustion engine and the temperature of the ignition coil. According to this embodiment, the microcomputer 12 uses an engine temperature measured at a sampling timing closer to the present processing cycle, which is obtained based on a detection value measured by the water temperature sensor 21. The microcomputer 12 multiplies a heat receiving coefficient with "the cooling water temperature—previous calculation value T(n−1)" to calculate the temperature change amount ΔT2. In this case, the sampling timing closer to the present processing cycle can be set to the previous sampling timing closest to the present processing cycle. The heat receiving coefficient can be prepared based on experimental data.

In the next step 420, the microcomputer 12 calculates a temperature change amount ΔT3 of ignition coil FC caused by the heat released to the outside, based on the previous calculated temperature T(n−1) of ignition coil FC and the intake air temperature of the internal combustion engine.

This temperature change amount is a change amount of the temperature in the period of time from the previous processing cycle to the present processing cycle in the flowchart shown in FIG. 10. The heat quantity released to the outside is proportional to a difference between the outside air temperature and the temperature of ignition coil FC. According to this embodiment, the microcomputer 12 uses the outside air temperature measured at a sampling timing closer to the present processing cycle, which is obtained based on a detection value of the intake air temperature sensor 23. The microcomputer 12 multiplies a heat releasing coefficient with "the outside air temperature—previous calculation value T(n−1)" to calculate the temperature change amount ΔT3. In this case, the sampling timing closer to the present processing cycle can be set to the previous sampling timing closest to the present processing cycle.

However, the heat releasing coefficient varies depending on the wind flowing near the ignition coil FC. According to this embodiment, the microcomputer 12 sets a variable heat releasing coefficient changeable with reference to the wind flowing near the ignition coil FC.

Figures 13A, 13B:
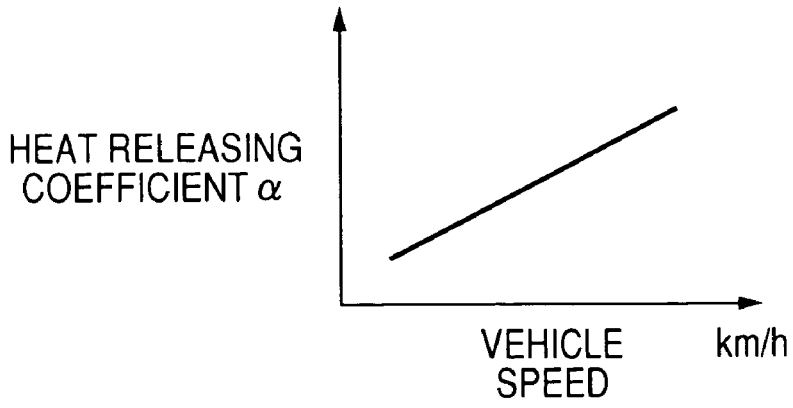
FIG. 13A is a table showing the relationship between the vehicle speed and the heat releasing coefficient in accordance with the preferred embodiment of the present invention.
FIG. 13B is a graph showing the relationship between the vehicle speed and the heat releasing coefficient in accordance with the preferred embodiment of the present invention.

More specifically, the microcomputer 12 uses a wind velocity measured at the sampling timing closer to the present processing cycle which is obtained based on the detection value of the vehicle speed sensor 24. In this case, the sampling timing closer to the present processing cycle can be set to the previous sampling timing closest to the present processing cycle. FIG. 13A is a map showing the relationship between the vehicle speed and the heat releasing coefficient. The microcomputer 12 calculates a proper heat releasing coefficient with reference to this map based on the vehicle speed relating to the wind velocity near the ignition coil FC. This map can be prepared based on experimental data. When the vehicle speed detected by the vehicle speed sensor 24 disagrees with the map data shown in FIG. 13A, the microcomputer 12 can obtain an appropriate correction coefficient by introducing the interpolation as shown in FIG. 13B.

Then, in step 430, the microcomputer 12 adds the change amounts ΔT1, ΔT2, and ΔT3 and then adds this summation with the previous calculation value T(n−1) to obtain a present calculated temperature T(n) of ignition coil FC.

Then, the microcomputer 12 terminates this processing.

According to the processing procedure shown in FIG. 10, the microcomputer 12 can successively calculate the temperature of ignition coil FC in sequential processing cycles.

According to this embodiment, the microcomputer 12 uses an initial value T(0) of the ignition coil temperature in the first processing cycle of FIG. 10 after the ignition switch is turned on.

Figure 14:
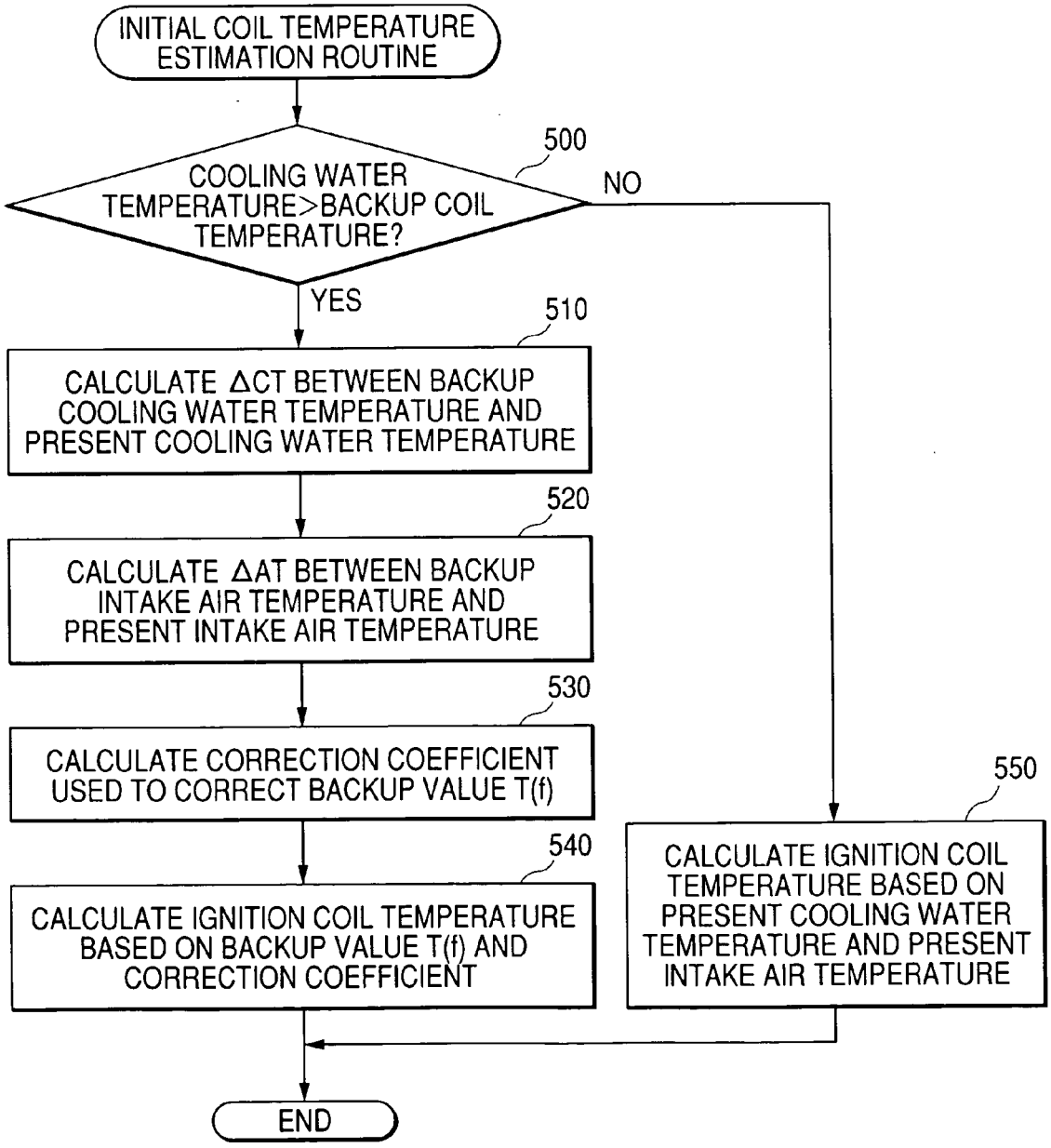
FIG. 14 is a flowchart showing the processing procedure for calculating the ignition coil temperature in an engine startup condition in accordance with the preferred embodiment of the present invention.

FIG. 14 is the processing procedure for obtaining the initial ignition coil temperature in a startup condition of the internal combustion engine, which is executed in response to the turning-on operation of the ignition switch, prior to the processing procedure of FIG. 10.

First, in step 500, the microcomputer 12 makes a judgment as to whether the present cooling water temperature detected by the water temperature sensor 21 is higher than a calculated temperature (backup value T(f)) of ignition coil FC.

This calculated temperature (backup value T(f)) of ignition coil FC is a value obtained before terminating the processing procedure of FIG. 10 in response to the turning-off operation of the ignition switch. This backup value T(f) is temporarily stored in a nonvolatile storage 12*m* of the microcomputer 12 shown in FIG. 1. The microcomputer 12 executes this processing to check whether a sufficient time has passed after the engine is stopped, i.e. to judge whether a thermal equilibrium condition has established between the ignition coil FC and its surrounding environment.

When the present cooling water temperature is higher than the calculated temperature (backup value T(f)) of ignition coil FC (i.e. YES in step 500), the microcomputer 12 calculates the temperature of ignition coil FC in the following sequential steps 510 to 540.

In the sequential steps 510 to 540, the microcomputer 12 calculates a heat quantity exchanged between the internal combustion engine and the outside air which corresponds to a temperature change of ignition coil FC relative to the backup value T(f).

First in step 510, the microcomputer 12 calculates a difference ΔCT between a backup value stored in the nonvolatile storage 12*m* and a newly detected value with respect to the cooling water temperature representing the temperature of the internal combustion engine. The nonvolatile storage 12*m* stores this backup value for the cooling water temperature in response to the turning-off operation of the ignition switch.

Furthermore, in step 520, the microcomputer 12 calculates a difference ΔAT between a backup value stored in the nonvolatile storage 12*m* and a newly detected value with respect to the intake air temperature representing the ambient temperature. The nonvolatile storage 12*m* stores this backup value for the intake air temperature in response to the turning-off operation of the ignition switch.

Next, in step 530, based on these differences ΔCT and ΔAT, the microcomputer 12 calculates a correction coefficient used to correct the backup value T(f) with respect to the temperature of ignition coil FC.

Then, in step 540, the microcomputer 12 calculates the temperature of ignition coil FC by multiplying the correction coefficient with the backup value T(f).

As apparent from the above-described steps 510 to 540, the microcomputer 12 calculates the temperature change of ignition coil FC based on the change in the intake air temperature and the change in the cooling water temperature which occur in the period of time from the latest stop of the engine operation to the present startup of the engine.

It is preferable that microcomputer 12 uses a map determining the relationship between the correction coefficient and the differences ΔCT and ΔAT.

Furthermore, this map can be obtained based on experimental data with respect to the relationship among the temperature changes of the intake air, the cooling water, and the ignition coil in the during from the latest stop of the engine operation to the present startup of the engine On the other hand, when the present cooling water temperature is not higher than the calculated temperature (backup value T(f)) of ignition coil FC (i.e. NO in step 500), the microcomputer 12 executes the processing of step 550 to calculate the temperature of ignition coil FC. In this case, the microcomputer 12 concludes that the substantially thermal equilibrium condition has established between the ignition coil FC and its surrounding environment including the internal combustion engine. Thus, the microcomputer 12 calculates the temperature of ignition coil FC based on the cooling water temperature representing the present temperature of the internal combustion engine and the intake air temperature representing the ambient temperature. In this case, it is preferable to obtain the ignition coil temperature by calculating a weighted average value of the cooling water temperature and the intake air temperature.

After finishing the processing of step 540 or step 550, the microcomputer 12 terminates this routine.

In this manner, according to this embodiment, the microcomputer 12 sets the predetermined value reflecting the initial temperature conditions of ignition coil FC according to the processing procedure shown in FIG. 14. The microcomputer 12 successively calculates the change amount in the temperature of ignition coil FC in the duration between processing timings of the processing procedure shown in FIG. 10. The microcomputer 12 can accurately calculate the temperature of ignition coil FC.

The microcomputer 12 executes the ignition control with reference to the power supply time determined based on the calculated temperature of ignition coil FC. It is not necessary to set a large margin for setting the power supply time. It becomes possible to set an appropriate power supply time within an allowable current region.

According to this control, it is possible to stabilize the control for supplying electric power to the ignition coil FC in each ignition timing control. The microcomputer 12 can accurately calculate the heat quantity generated from the ignition coil FC in the step 400 of FIG. 10 based on the rotational speed of the internal combustion engine.

As apparent from the foregoing description, this embodiment provides a control apparatus for an internal combustion engine that controls electric power supplied to ignition coil FC. A power supply amount is determined based on a resistance characteristic value of ignition coil FC that represents either a resistance value of ignition coil FC or a physical quantity having correlation with the resistance value.

The control apparatus of this embodiment sets a predetermined initial value of the resistance characteristic value with reference to initial conditions. The control apparatus calculates a change amount of resistance characteristic value in the period of time from the previous calculation timing to the present calculation timing with reference to operating conditions of the engine. And, the control apparatus calculates a present resistance characteristic value based on the calculated change amount and the resistance characteristic value obtained at the previous calculation timing.

In general, the resistance value of ignition coil FC changes in accordance with the ignition coil temperature. Accordingly, when the power supply amount is determined based on the resistance characteristic value of ignition coil FC, it is desirable to appropriately detect the change of the resistance characteristic value of ignition coil FC. The ignition coil temperature changes due to the heat generating from ignition coil FC, the heat received from the outside, and the heat released to the outside.

The control apparatus of this embodiment calculates the change amount of the resistance characteristic value in the period of time from the previous calculation timing to the present calculation timing based on operating conditions of the engine. The control apparatus of this embodiment obtains the present resistance characteristic value by adding the calculated change amount of the resistance characteristic value to a previous resistance characteristic value. Thus, this embodiment enables the control apparatus to successively and accurately calculate the resistance characteristic value which momentarily changes in accordance with operating conditions of the engine. It becomes possible to appropriately control the electric power amount supplied to ignition coil FC.

According to this embodiment, the resistance characteristic value is a temperature of ignition coil FC. The control apparatus can easily calculate the temperature change of ignition coil FC based on the heat generation of ignition coil FC, the heat received from the outside, and the heat released to the outside. The processing required for the power supply control is simple. It is easy to directly measure the ignition coil temperature.

Furthermore, according to this embodiment, the control apparatus calculates the change amount of the resistance characteristic value obtained at the previous calculation timing and a rotational speed of the internal combustion engine.

The heat generated from ignition coil FC is one of main factors inducing any change in the resistance characteristic value of ignition coil FC. The heat generated from ignition coil FC is proportional to a square of the electric power amount supplied to ignition coil FC and also proportional to the resistance value of ignition coil FC. The heat quantity generated from ignition coil FC is thus proportional to a multiplication of these values.

The power supply amount required for one firing action of the ignition device should be somewhere within an allowable current range. The electric power amount supplied to ignition coil FC is proportional to the number of firing actions. In other words, the power supply amount has a correlation with the rotational speed of an internal combustion engine.

The control apparatus of this embodiment calculates the change amount of resistance characteristic value with reference to the resistance characteristic value obtained at the previous calculation timing and the rotational speed of the internal combustion engine. It is therefore possible to appropriately calculate the change amount of the resistance characteristic value resulting from the heat generated from ignition coil FC.

Furthermore, according to this embodiment, the control apparatus calculates the change amount based on a difference between the resistance characteristic value obtained at the previous calculation timing and a temperature of the internal combustion engine which are expressed by using the same dimension.

A temperature rise in ignition coil FC caused by the heat received from the internal combustion engine is one of main factors inducing any change in the resistance characteristic value of ignition coil FC. The heat quantity received from ignition coil FC is proportional to a temperature difference between the internal combustion engine and ignition coil FC. The resistance value of ignition coil FC has correlation with the ignition coil temperature. Therefore, the heat quantity received from ignition coil FC is proportional to a different between the temperature of the internal combustion engine and the resistance characteristic value which are expressed by using the same dimension.

The control apparatus of this embodiment adequately calculates the change amount of the resistance characteristic value caused by the heat received from the internal combustion engine in the period of time from the previous calculation timing to the present calculation timing. Namely, the control apparatus calculate the change amount of the resistance characteristic value on a difference between the resistance characteristic value obtained in the previous calculation timing and the temperature of the internal combustion engine which are expressed by using the same dimension.

When the resistance characteristic value is the ignition coil temperature, it is possible to calculate a change amount of the ignition coil temperature in the period of time from the previous calculation timing to the present calculation timing, based on a difference between the engine temperature and the ignition coil temperature obtained at the previous calculation timing.

Furthermore, the control apparatus of this embodiment calculates the change amount based on a difference between the resistance characteristic value obtained at the previous calculation timing and the ambient temperature of ignition coil FC which are expressed by using the same dimension.

The heat received from or released to the outside of ignition coil FC is one of main factors inducing any change in the resistance characteristic value of ignition coil FC. The heat quantity received from or released to the outside is proportional to a difference between the ambient temperature and the ignition coil temperature. The resistance value of ignition coil FC has correlation with the ignition coil temperature. Accordingly, the heat quantity received from or released to the outside is proportional to a difference between the ambient temperature and the resistance characteristic value which are expressed by using the same dimension.

The control apparatus of this embodiment adequately calculates the change amount of the resistance characteristic value resulting from the heat quantity received and released in the period of time from the previous calculation timing to the present calculation timing, based on a difference between the resistance characteristic value obtained at the previous calculation timing and the ambient temperature of ignition coil FC.

When the resistance characteristic value is the ignition coil temperature, it is possible to calculate a change amount of the ignition coil temperature in the period of time from the previous calculation timing to the present calculation timing, based on a difference between the ambient temperature and the ignition coil temperature obtained at the previous calculation timing.

Furthermore, according to this embodiment, the temperature of the internal combustion engine is detected as the temperature of the cooling water flowing in the internal combustion. The internal combustion engine is equipped with the water temperature sensor detecting the temperature of the cooling water flowing in the engine. The cooling water temperature appropriately represents the temperature of the internal combustion engine.

The control apparatus of this embodiment appropriately calculates the released heat quantity by detecting the temperature of the internal combustion engine as the temperature of cooling water without newly providing a detecting device.

Furthermore, the control apparatus of this embodiment detects the ambient temperature of ignition coil FC as the temperature of the intake air introduced into the internal combustion engine.

The internal combustion engine is equipped with the intake air temperature sensor detecting the temperature of the intake air introduced into the internal combustion engine. The intake air temperature appropriately represents the ambient temperature of ignition coil FC.

The control apparatus of this embodiment appropriately calculates the heat quantity exchanged between ignition coil FC and its surrounding environment by detecting the ambient temperature of ignition coil FC as the temperature of the intake air introduced into the internal combustion engine without newly providing a detecting device.

Furthermore, the control apparatus of this embodiment calculates the change amount of the resistance characteristic value by multiplying a coefficient with the difference. This coefficient relates to the traveling speed of a vehicle installing the internal combustion. This difference is obtained as a difference between the resistance characteristic value obtained at the previous calculation timing and the ambient temperature of ignition coil FC which are expressed by using the same dimension.

The heat quantity released from ignition coil FC to its surrounding environment changes in accordance with the flow velocity of the air surrounding ignition coil FC. On the other hand, the automotive vehicle installing the internal combustion engine is equipped with the vehicle speed sensor detecting the traveling speed of this vehicle. The vehicle traveling speed appropriately represents the flow velocity of the air surrounding ignition coil FC.

The control apparatus of this embodiment appropriately calculates the heat quantity released from ignition coil FC to its surrounding environment by using the coefficient reflecting the traveling speed of automotive vehicle without newly providing a detecting device.

Furthermore, the control apparatus of this embodiment determines the predetermined initial value of the resistance characteristic value based on at least one of the engine temperature and the outside air temperature in an engine startup condition.

When the engine is in a stopped condition, the resistance characteristic value of ignition coil FC changes in response to the heat received from the internal combustion engine and the heat released to the outside air. The heat quantity received from the internal combustion engine is dependent on the temperature of the internal combustion engine. Furthermore, the heat quantity released to the outside air is dependent on the outside air temperature.

The control apparatus of this embodiment accurately calculates the initial value of the resistance characteristic value with reference to the temperature change of ignition coil FC in an engine stopped condition by using at least one of the engine temperature and the outside air temperature.

Furthermore, the control apparatus of this embodiment determines the predetermined value with reference to the resistance characteristic value, when the cooling water temperature in the engine startup condition is higher than the ignition coil temperature corresponding to the resistance characteristic value in the engine stopped condition.

When a relatively short time has passed after the engine is stopped, the present cooling water temperature will be higher than the ignition coil temperature. The ignition coil and its surrounding environment will not reach a thermal equilibrium condition. Therefore, the control apparatus of this embodiment calculates the resistance characteristic value in an engine startup condition with reference to the change in the resistance characteristic value occurring after stopping the engine in response to the temperature change of ignition coil FC. Accordingly, the control apparatus can accurately calculate the resistance characteristic value.

Furthermore, the above-described embodiment provides another control apparatus for an internal combustion engine that controls electric power supplied to ignition coil FC with a power supply amount determined based on the temperature of an ignition coil. The control apparatus calculates the temperature of ignition coil FC based on at least one heat quantities selected from the group consisting of the heat quantity generated from ignition coil FC, the heat quantity received by ignition coil FC, and the heat quantity released from ignition coil FC, which are heat quantities calculated in accordance with operating conditions of the engine.

The ignition coil temperature changes depending on the heat generating from ignition coil FC, the heat received from the outside, and the heat released to the outside.

The control apparatus of this embodiment successively and accurately calculates the ignition coil temperature varying in response to operating conditions of the engine by calculating the ignition coil temperature based on at least one of the heat quantities selected from the group consisting of the heat quantity generated from ignition coil FC, the heat quantity received by ignition coil FC, and the heat quantity released from ignition coil FC. Therefore, the control apparatus can appropriately control an electric power amount supplied to ignition coil FC.

Furthermore, the control apparatus of this embodiment calculates the requisite time required for the crank shaft of the internal combustion engine to rotate from the present crank angle to a designated crank angle corresponding to ignition timing. And, the control apparatus calculates the requisite time by predicting a relationship between times required for the crank shaft to rotate consecutive angular regions positioned before and after the present crank angle based on measurement results with respect to times required for the crank shaft to rotate consecutive angular regions positioned before and after a preceding crank angle advanced a predetermined amount from the present crank angle.

Accordingly, the control apparatus of this embodiment can accurately calculate the requisite time considering rotational fluctuations of the crank shaft occurring due to various factors. It is possible to reduce the margin required in the setting of the power supply time. The power supply time can be surely set in the allowable current range. Accordingly, the resistance characteristic value can be accurately calculated. An appropriate power supply amount is obtained.

As apparent from the foregoing description, this embodiment brings the following various effects.

(1) The control apparatus can calculate the temperature change amount of ignition coil FC in the period of time from the previous calculation timing to the present calculation timing based on operating conditions of the engine. Thus, the control apparatus can successively and accurately calculate the temperature of ignition coil FC which momentarily changes in accordance with the operating conditions of the engine.

(2) The control apparatus can accurately calculate the temperature change amount caused by the heat generated from the ignition coil FC based on the rotational speed of the internal combustion engine and the previous calculation temperature T(n−1) of ignition coil FC.

(3) The control apparatus obtains the temperature rise amount caused by the heat generated from ignition coil FC with reference to the one-dimensional maps shown in FIGS. 11A and 12A. Using these one-dimensional maps is effective in reducing the map data, compared with a case that the control apparatus uses a two-dimensional map defining the relationship among the rotational speed of the internal combustion engine, the previous calculated temperature T(n−1), and the temperature rise amount of ignition coil FC.

(4) The control apparatus can accurately calculate the temperature change amount of ignition coil FC caused by the received heat, based on the difference between the cooling water temperature and the previous calculated temperature T(n−1) of ignition coil FC.

(5) The control apparatus can accurately calculate the temperature change amount of ignition coil FC caused by the released heat, based on the difference between the intake air temperature and the previous calculated temperature T(n−1) of ignition coil FC.

(6) The control apparatus can accurately calculate the temperature change amount of ignition coil FC caused by the released heat, by using the heat releasing coefficient which is variably set in accordance with the vehicle speed.

(7) The control apparatus can calculate the initial temperature of ignition coil FC based on the cooling water temperature and the intake air temperature when the ignition switch is turned on to start the operation of the internal combustion engine. Thus, the control apparatus can accurately calculate the temperature of ignition coil FC in the startup condition.

(8) The control apparatus can change the method of calculating the temperature of ignition coil FC in the startup condition, with reference to the judgment result as to whether a sufficient time has passed after the engine is stopped, i.e. whether a thermal equilibrium condition has established between the ignition coil FC and its surrounding environment. Thus, the control apparatus can accurately calculate the temperature of ignition coil FC in the startup condition.

(9) The control apparatus calculates a requisite time required for the crank shaft of the internal combustion engine to rotate from the present crank angle to a designated crank angle corresponding to ignition timing. And, the control apparatus calculates the requisite time by predicting a relationship between times required for the crank shaft to rotate consecutive angular regions positioned before and after the present crank angle based on measurement results with respect to times required for the crank shaft to rotate consecutive angular regions positioned before and after a preceding crank angle advanced a predetermined amount from the present crank angle. Accordingly, the control apparatus can accurately calculate the requisite time considering rotational fluctuations of the crank shaft occurring due to various factors.

(10) The microcomputer 12 does not perform the calculations for setting the ignition timing or the like again after the power supply operation once starts. The power supply time being set as an appropriate value is not renewed or changed. The microcomputer 12 can accurately control the current flowing in the ignition coil FC with the power supply time which is set to provide an appropriate power supply amount.

OTHER EMBODIMENTS

The above-described embodiment can be modified in the following manner.

The temperature change amount caused by the heat generated from the ignition coil can be calculated without using the maps shown in FIGS. 11A and 12A.

For example, it is possible to use a map defining the relationship between the engine rotational speed and the power supply amount and a map defining the relationship between the ignition coil temperature and the resistance value of an ignition coil. In this case, the temperature change amount caused by the heat generated from the ignition coil can be calculated by multiplying the square of power supply amount with the resistance value.

The method of calculating the temperature change amount caused by the heat received from the internal combustion engine is not limited to the calculation disclosed in above-described embodiment. For example, a physical quantity representing the engine temperature is not limited to the cooling water temperature.

The method of calculating the temperature change amount caused by the heat released to the outside is not limited to the calculation disclosed in above-described embodiment. For example, it is possible to use a two-dimensional map defining the relationship among the vehicle speed, the intake air temperature, and the temperature change amount of the ignition coil caused by the heat released to the outside.

The control apparatus calculates the requisite time required for the crank shaft of the internal combustion engine to rotate from the present crank angle to a designated crank angle corresponding to ignition timing. The control apparatus calculates the requisite time by predicting a relationship between times required for the crank shaft to rotate consecutive angular regions positioned before and after the present crank angle based on measurement results with respect to times required for the crank shaft to rotate consecutive angular regions positioned before and after a preceding crank angle advanced a predetermined amount from the present crank angle. However, the method of calculating the requisite time is not limited to the calculation disclosed in the above-described embodiment.

According to the above-described embodiment, the control apparatus calculates the temperature change amount of the ignition coil in the period of time from the previous calculation timing to the present calculation timing. However, it is not necessary to use the previous calculated temperature of the ignition coil. In short, the temperature change amount of the ignition coil in the period of time from the previous calculation timing to the present calculation timing should be calculated based on an appropriate prior temperature of the ignition coil.

The method of calculating the temperature change amount of the ignition coil in the period of time from the previous calculation timing to the present calculation timing is not limited to the calculation disclosed in the above-described embodiment.

For example, if the ignition coil FC is embedded in the cylinder head CH shown in FIG. 2, the ignition coil FC will not be brought into direct contact with the outside air. In such a case, it is possible to omit the processing of step 420 shown in FIG. 10.

Furthermore, if the heat generated from the ignition coil is negligible, it will be possible to omit the processing of step 400 shown in FIG. 10.

The method of setting the predetermined value reflecting the initial conditions of the ignition coil is not limited to the calculation disclosed in the above-described embodiment. For example, if the ignition coil FC is embedded in the cylinder head CH shown in FIG. 2, the ignition coil FC will not be brought into direct contact with the outside air. In such a case, it is possible to set the predetermined value reflecting the initial conditions of the ignition coil based only on the cooling water temperature.

The resistance characteristic value of the ignition coil represents either the resistance value of the ignition coil or the physical quantity having correlation with this resistance value. In this respect, the resistance characteristic value of the ignition coil is not limited to the temperature of the ignition coil. For example, when the resistance characteristic value of the ignition coil is the resistance value of the ignition coil, in calculating the temperature change amount of the ignition coil caused by the received heat, it is possible to use a difference between the engine temperature and the resistance value of the ignition coil which are expressed by using the same dimension.

The internal combustion engine is not limited to a four-cylinder engine.

What is claimed is:

1. A control apparatus for an internal combustion engine installed on a vehicle, said apparatus controlling electric power supplied to an ignition coil in an amount determined based on a resistance characteristic value of said ignition coil representing either a resistance value of the ignition coil or a physical quantity having correlation with said resistance value, the control apparatus comprising:

means for calculating a change in said resistance characteristic value in an elapsed time period from a previous calculation to a present calculation with reference to operating conditions of said engine; and means for calculating a present resistance characteristic value based on said calculated change and the resistance characteristic value obtained at the previous calculation.

2. A control apparatus for an internal combustion engine as in claim 1 further comprising:

means for setting a predetermined initial resistance characteristic value reflecting initial conditions of the internal combustion engine.

3. A control apparatus for an internal combustion engine as in claim 1 wherein said resistance characteristic value includes temperature conditions of said ignition coil.

4. A control apparatus for an internal combustion engine as in claim 3 wherein the temperature conditions of said ignition coil include at least one of (a) a heat quantity generated by the ignition coil, (b) a heat quantity received by the ignition coil and (c) a heat quantity released from the ignition coil.

5. A control apparatus for an internal combustion engine as in claim 4 wherein the heat quantity generated by the ignition coil is calculated based on rotational speed of said internal combustion engine.

6. A control apparatus for an internal combustion engine as in claim 4 wherein the heat quantity received from the ignition coil is calculated based on temperature of cooling water in said internal combustion engine.

7. A control apparatus for an internal combustion engine as in claim 4 wherein the heat quantity released from the ignition coil is calculated based on temperature of intake air introduced into said internal combustion engine.

8. A control apparatus for an internal combustion engine as in claim 4 wherein the heat released from the ignition coil is calculated based on a coefficient of heat release variably set depending on vehicle speed.

9. A control apparatus for an internal combustion engine as in claim 4 wherein said change in resistance characteristic value is calculated by multiplying a coefficient related to vehicle speed with a difference between said resistance characteristic value obtained at the previous calculation and a presently calculated value.

10. A control apparatus for an internal combustion engine as in claim 2 wherein said predetermined initial resistance characteristic value is determined based on at least one of (a) engine temperature and (b) outside air temperature.

11. A control apparatus for an internal combustion engine as in claim 10 wherein:

said predetermined value is determined with reference to the resistance characteristic value when cooling water temperature of said engine is higher than ignition coil temperature, corresponding to said resistance characteristic value in an engine stopped condition.

12. A control apparatus for an internal combustion engine as in claim 1 wherein:

said control apparatus calculates a requisite time required for a crank shaft of an internal combustion engine to rotate from a present crank angle to a designated crank angle corresponding to ignition timing; and said control apparatus calculates said requisite time by predicting a relationship between times required for said crank shaft to rotate consecutive angular regions positioned before and after said present crank angle based on measured results with respect to times required for said crank shaft to rotate consecutive angular regions positioned before and after a preceding crank angle advanced a predetermined amount from said present crank angle.

13. A control apparatus for an internal combustion engine, said apparatus controlling electric power supplied to an ignition coil in an amount determined based on temperature of the ignition coil, wherein:

said control apparatus calculates ignition coil temperature based on at least one of (a) a heat quantity generated from said ignition coil, (b) a heat quantity received by said ignition coil, and (c) a heat quantity released from said ignition coil, which heat quantities are calculated in accordance with operating conditions of said engine.

14. A control apparatus for an internal combustion engine as in claim 13, wherein:

said control apparatus calculates a requisite time required for a crank shaft of an internal combustion engine to rotate from a present crank angle to a predetermined crank angle corresponding to ignition timing, and said control apparatus calculates said requisite time by predicting a relationship between times required for sand crank shaft to rotate consecutive angular regions positioned before and after said present crank angle based on measurement results with respect to times required for said crank shaft to rotate consecutive angular regions positioned before and after a preceding crank angle advanced a predetermined amount from said present crank angle.

15. A control apparatus for an internal combustion engine installed on a vehicle, said apparatus controlling electric power supplied to an ignition coil, the control apparatus comprising:

means for calculating a change in coil resistance characteristic value in elapsed time from a previous calculation to a present calculation with reference to operating conditions of said engine in response to temperature information;

means for calculating a present resistance characteristic value based on said calculated change and the resistance characteristic value obtained at a previous calculation; and means for controlling electric power supplied to the ignition coil based on the present resistance characteristic value.

16. A method of controlling electric power supplied to an ignition coil of an internal combustion engine installed on a vehicle, said method comprising:

calculating a change in resistance characteristic value in the period of elapsed time from a previous calculation to a present calculation with reference to operating conditions of said engine;

calculating a present resistance characteristic value based on said calculated change and the resistance characteristic value obtained at a previous calculation; and controlling electric power supplied to the ignition coil based on the present resistance characteristic value.

17. A method as in claim 16 further comprising:

setting a predetermined initial resistance characteristic value reflecting initial conditions of the internal combustion engine.

18. A method as in claim 16 wherein said resistance characteristic value includes temperature conditions of said ignition coil.

19. A method as in claim 18 wherein the temperature conditions of said ignition coil include at least one of (a) a heat quantity generated by the ignition coil, (b) a heat quantity received by the ignition coil, and (c) a heat quantity released from the ignition coil.

20. A method as in claim 19 wherein the heat quantity generated by the ignition coil is calculated based on rotational speed of said internal combustion engine.

21. A method as in claim 19 wherein the temperature conditions of said ignition coil include heat released from the ignition coil.

22. A method as in claim 19 wherein the heat released from the ignition coil is calculated based on temperature of intake air introduced into said internal combustion engine.

23. A method as in claim 19 wherein the heat quantity received from the ignition coil is calculated based on temperature of cooling water in said internal combustion engine.

24. A method as in claim 19 wherein the heat quantity released from the ignition coil is calculated based on temperature of intake air introduced into said internal combustion engine.

25. A method as in claim 19 wherein said predetermined initial resistance characteristic value is determined based on at least one of (a) engine temperature and (b) outside air temperature.

26. A method as in claim 19 wherein heat released from the ignition coil is calculated based on a coefficient of heat release variably set depending on vehicle speed.

* * * * *